United States Patent [19]

McKinnon et al.

[11] 4,095,642

[45] Jun. 20, 1977

[54] PLASTIC STRIP DOOR

[75] Inventors: Donald J. McKinnon; Duane M. McKinnon, both of Chino, Calif.

[73] Assignee: Cool Curtain, Inc., Pomona, Calif.

[21] Appl. No.: 819,329

[22] Filed: Jul. 27, 1977

[51] Int. Cl.[2] ..... A47H 1/00

[52] U.S. Cl. ..... 160/332

[58] Field of Search ..... 160/184, 196 R, 196 D, 160/332, 130; 61/1 F

[56] References Cited

U.S. PATENT DOCUMENTS

| | | | |
|---|---|---|---|
| 1,649,943 | 11/1927 | Boeck | 160/130 |
| 3,331,425 | 7/1967 | Groves et al. | 160/184 |

FOREIGN PATENT DOCUMENTS

| | | | |
|---|---|---|---|
| 255,879 | 7/1964 | Australia | 160/184 |
| 975,286 | 9/1975 | Canada | 160/332 |
| 882,638 | 11/1961 | United Kingdom | 160/184 |
| 979,026 | 1/1965 | United Kingdom | 160/184 |
| 1,243,176 | 8/1971 | United Kingdom | 61/1 F |

*Primary Examiner*—Peter M. Caun

*Attorney, Agent, or Firm*—Knobbe, Martens, Olson, Hubbard & Bear

[57] ABSTRACT

Strips of heavy transparent plastic are suspended in a doorway with the edge of each strip overlapping an adjacent strip to completely close the doorway in a manner which minimizes heat transfer through the doorway while permitting hand-free movement through the door. The strips are suspended by loops formed on the upper end of each strip. Various loop constructions and overlap arrangements are disclosed to facilitate the mounting of the strips.

14 Claims, 13 Drawing Figures

FIG. 12.
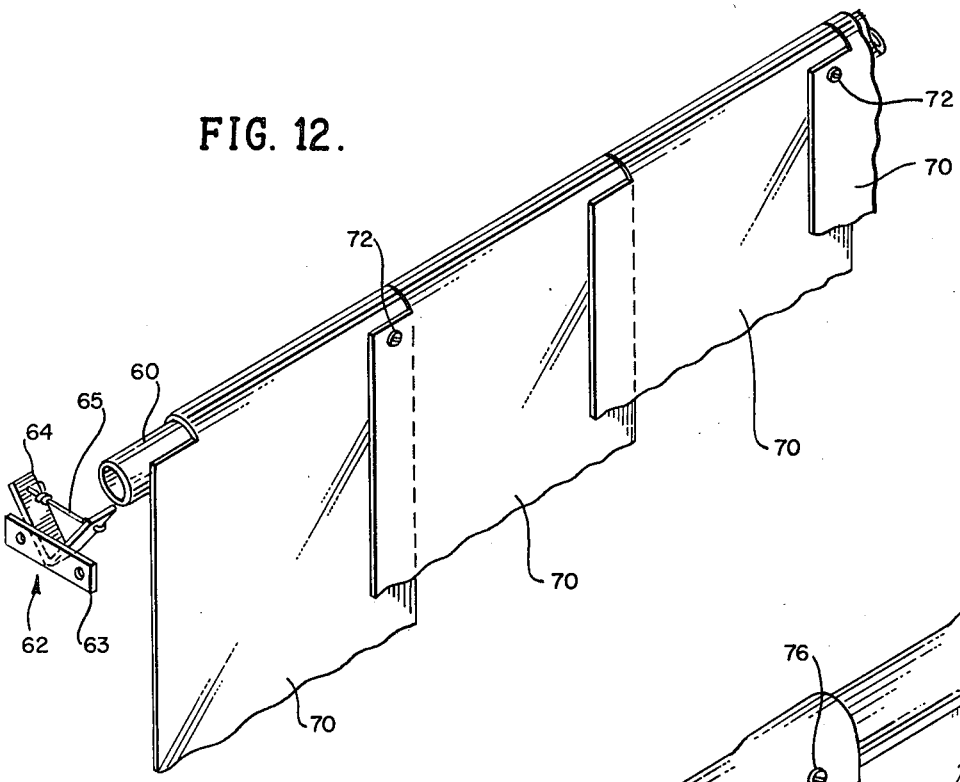
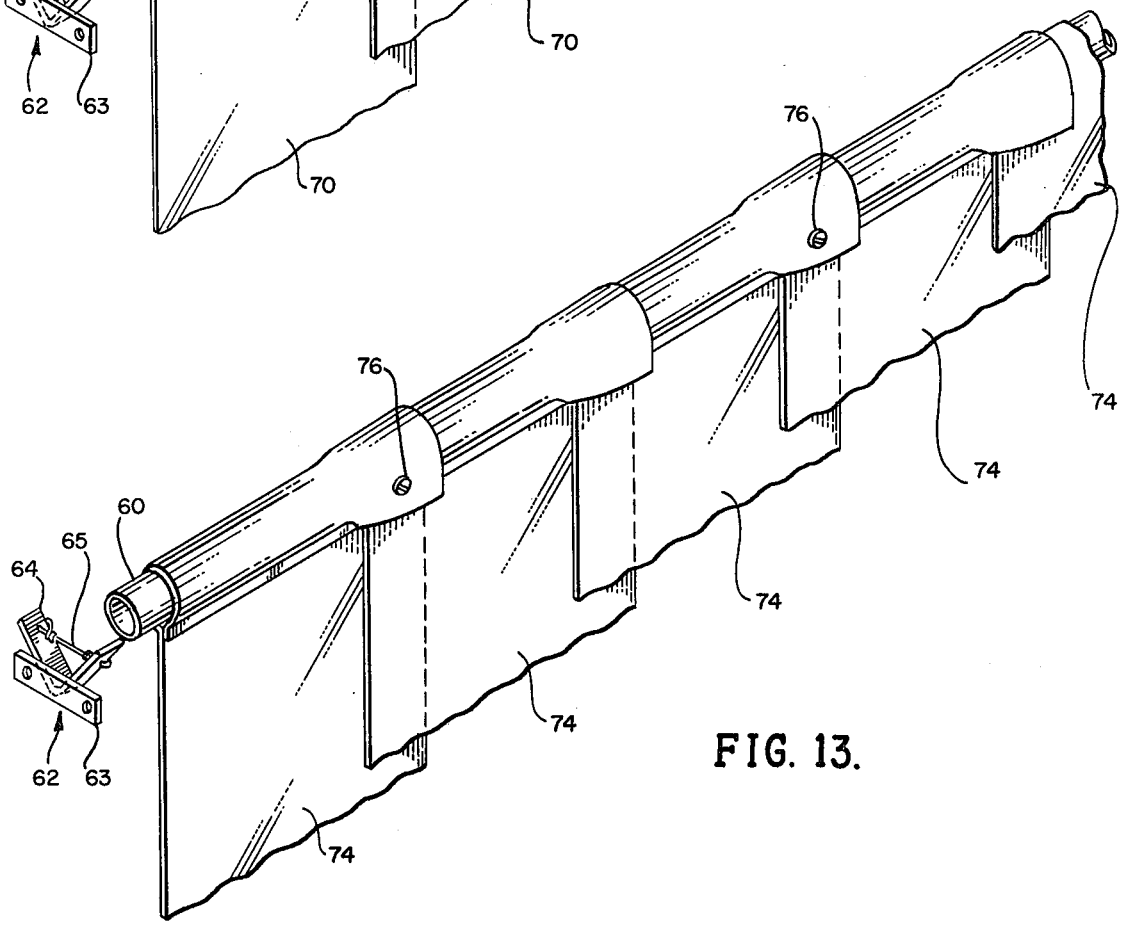
FIG. 13.

PLASTIC STRIP DOOR

This invention relates to an improved mounting arrangement for plastic strip doors wherein a plurality of plastic strips are hung in overlapping arrangement in a doorway to provide a heat barrier that is still easy to walk through.

Plastic strip doors have recently become increasingly useful because of the emphasis on energy conservation. There are a tremendous number of situations wherein a conventional hinged or sliding door is not satisfactory for retaining heat or cold within a room because the need to move people or goods frequently through the doorway makes it impractical to keep opening and closing a conventional door. For example, a cold storage room within a warehouse often is provided with a conventional heavily insulated door which is quite satisfactory when the room is closed. However, when there is to be considerable traffic through the doorway, it is not practical to continue to open and close the door, and common practice has been to simply leave the door open. This of course results in a tremendous waste of cold air flowing out of the room.

A plastic strip door in addition to the regular door very practically and satisfactorily solves this need in that the heavy overlapping plastic strips always assume a vertical position which provides a satisfactory barrier to the transfer of air through the doorway. Yet the strips are easily parted without having to use his hands and the strips are preferably made of transparent plastic so that there is no safety problem. In other situations, plastic strip doors are useful where no door is now used.

In either application, it is important that their cost be minimized in order to best justify their use in that unless they actually save money from energy savings, their acceptance will be slow. The manner by which plastic strip doors have usually been mounted greatly adds to the cost of the doors because of the time required. Typically, the strips have been placed on a horizontal surface in the desired overlapping arrangement, and the upper ends of the strips have been clamped between two metal mounting bars which are then held in the clamped position by a plurality of bolts or other fasteners. The entire assembly is then lifted and attached to a wall with additional fastners. Such an arrangement typically requires two workmen several hours to complete a job. If a strip should later become worn or damaged, the entire door usually had to be removed in order to replace a single strip.

Accordingly, a need exists for improving the manner by which such plastic strip doors are mounted. While some attempts have been made at improved arrangements, most of the strip doors continued to be mounted in the old clamped manner described above until the system described herein was developed.

In accordance with the present invention, a loop is formed on the upper end of each strip for mounting purposes and various techniques are employed for permitting the overlapping of adjacent strips so as to provide an efficient practical method of mounting the strips. A loop is formed on one end of the strip by folding the end upon itself and heat bonding the end edge of the strip against the body of the strip at a point spaced from the end to create a loop of the desired size. To permit the strips to overlap each other, one edge of the strip in the loop area is not bonded or otherwise directly connected to the body of the strip. Thus, the unattached loop portion can fit over the loop of an adjacent strip.

In assemblying the strips, one end of a mounting bar may be attached to the mounting wall or other support area and the loop portion of a strip simply slipped over the mounting bar. When the desired number of strips have been installed on the bar, the remainder of the mounting arrangement for the bar may then be completed. Similarly, when it is desired to replace a strip, it is only necessary to release one end of the attaching bar and slip off the necessary strips to reach the strip to be replaced, install a new strip, and then reposition the others.

The width of the unbonded or unattached area of the loop may be varied to provide the overlap desired. However, if a large amount of overlap is desired, it is preferable that some of the loop material be eliminated because the double thickness in the overlapping loop area can produce some vertical tilting of the strips. Thus, to increase the permitted overlap, the loop on the edge of the strip opposite from the unbonded portion is completely cut away, preferably along the heat bonded band so that an upper edge of double thickness is provided to enhance the ability of the strip to support itself in that area. The cutaway or notched edge of the loop can then be overlapped with an unbonded or unattached loop portion of an adjacent strip so that the combined overlap is equal to the width of the notched loop edge and the unbonded loop edge. With this approach, a strip door of double thickness may be provided. A door of this nature is desirable in certain applications such as where there may be considerable air movement that might tend to move the door.

In another arrangement, the folded over loop portion which is unbonded is cut away leaving only a single thickness of plastic in that area of the loop but with this single thickness extending to near the top of the loop. With this arrangement, the overlapping of the strips does not produce any vertical tilting of the strips and thus is quite useful for doors employing narrower strips, such as four inches. With the strips arranged in a continuous overlapping pattern, known as shiplap, the single thickness strip portion in the loop area is clamped between the mounting bar and the adjacent wall. Another advantage of this half cutout loop arrangement is that the strips may be arranged in a manner wherein the overlapping of each strip on both edges is on the same side with respect to the two adjacent strips. Such an arrangement is convenient for providing a double thickness door that is still very easy to walk through because the overlap arrangement does not require much displacement of the strip material.

For a more thorough understanding of the invention refer now to the following detailed description and drawings in which:

FIG. 12 is a perspective view of the strips of FIG. 8 on a tubular support bar; and FIG. 13 is a perspective view of the strips of FIG. 2 on a tubular support.

Figure 1:
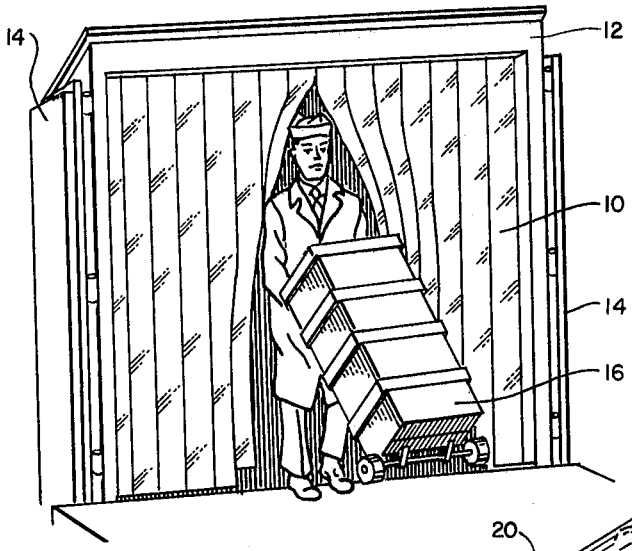
FIG. 1 is a perspective view illustrating a plastic strip door in the rear of a truck from which goods are being unloaded.

Referring now to FIG. 1, the general idea of a plastic strip door is illustrated wherein a plurality of strips 10 are suspended from above across the rear of a truck 12. The regular or conventional hinged doors 14 have been folded back out of the way to permit the truck to be unloaded. Each strip overlaps the edge of an adjacent strip to provide a continued thermal barrier across the end of the truck since the strips are made of a relatively heavy plastic material. However, the strips are easily parted as shown by the man moving a stack of boxes 16 through the doorway. After the man passes, the strips will quickly return to their normal vertically hanging position. Thus, the door is only momentarily open so that a minimum of heat transfer through the door occurs. The plastic strips are made of transparent material so that the worker can move with confidence through the door by being able to see whether there is any obstruction on either side.

Figure 2:
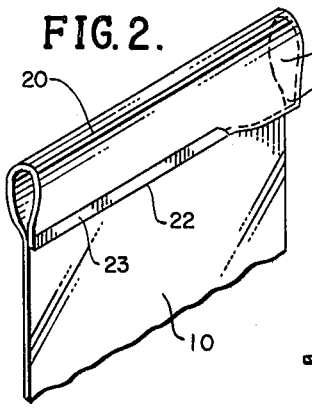
FIG. 2 is a perspective view of the upper end of one strip illustrating one form of loop construction.
Figure 3:
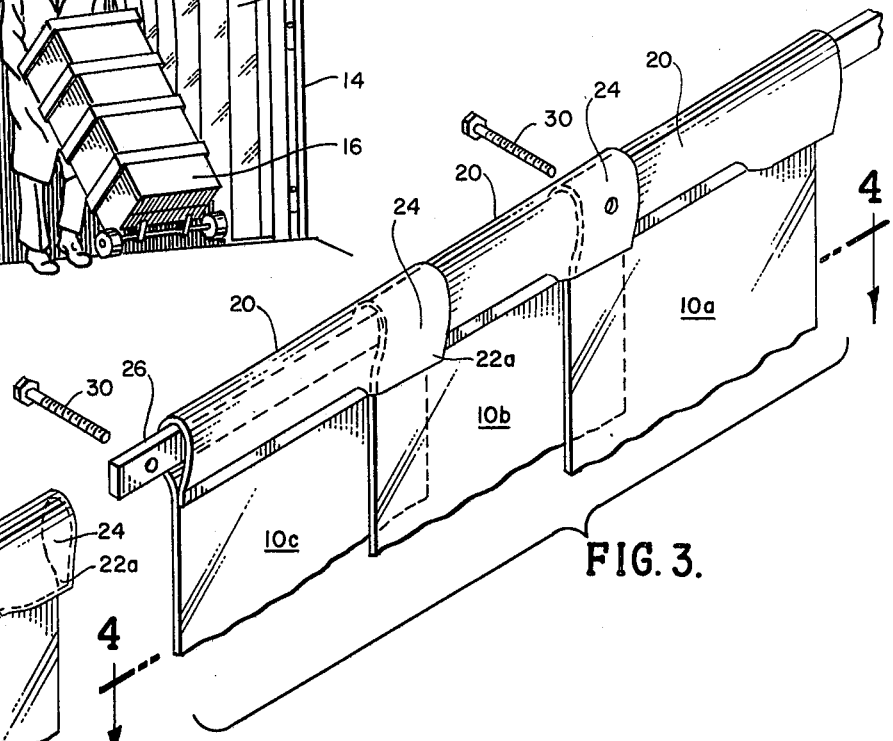
FIG. 3 is a perspective view of the upper end of a series of loops of the type shown in FIG. 2 illustrating the manner in which they are mounted.
Figure 4:
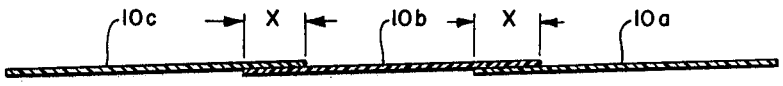
FIG. 4 is a cross-sectional view on lines 4—4 of FIG. 3 showing the overlap of adjacent strips.

FIGS. 2, 3 and 4 illustrate one preferred mounting arrangement for the strips. The strip 10 is shown in FIG. 2 as having its upper end folded on itself to form a loop 20. The end edge 22 of the strip is securely attached to the body of the strip by heat welding. As seen, the weld band 23 extends from the left hand edge of the strip across the strip except leaving an unbonded or unattached loop portion 24 on the right edge of the strip.

In FIG. 3, three strips 10 of the type shown in FIG. 2 are shown in their mounted position with a mounting bar 26 extending through the loops. In assembly, the strips may be installed from either end of the bar. In one approach, the strip **10*a* on the right is first slipped onto the bar followed by the second or middle strip 10*b*, and the unbonded or unattached portion 24 of the second strip 10*b* is slipped over the left edge of the strip 10*a*. Similarly, the unbonded portion 24 of the left strip 10*c* is slipped over the left edge of the middle strip 10*b*. As can be seen from FIGS. 3 and 4, this creates an overlap area on each edge of the middle strip 10*b*. The amount of the overlap X can be varied as desired, but typically amounts to about a quarter of the width of the strip. One common strip width is 8 inches, thus the unbonded portion 24** which equals the overlap X would equal about 2 inches on each edge.

With the strips placed in overlapping arrangement, the mounting bar 26 is attached to a wall or other support surface above the doorway by suitable fastners 30. In the arrangement shown in FIG. 3, the wall (not shown) would be positioned on the reader side of the page, as if it were attached to the inside wall of the truck shown in FIG. 1 above the doorway. When the strips are mounted against a flat wall, the corner **22*a* of the upper edge of the strip which is in the unbonded portion 24 is preferably placed between the mounting bar 26 and the supporting wall. The fasteners 30 are spaced along the bar 26** at suitable intervals, such as about 20 inches.

All the strips may be mounted on the bar and then the bar put in place, or preferably one end of the bar is loosely mounted and the loops are then slipped onto the other end of the bar.

Since the strips 10 are made of a pliable plastic material, they are formed into essentially a straight line by the mounting bar and by the adjacent wall. Thus, the strips are actually deformed or curved slightly, particularly in the overlap areas, rather than being in the completely straight line, continuous offset illustration shown in FIG. 4.

One of the particularly convenient features of a strip door is that it can be made in any desired width simply by assemblying the proper number of strips. However, for particularly narrow doorways, it is desirable that a strip narrower than the 8 inch strip shown in FIGS. 2–4 be employed in that it takes only a small number of strips to cover the door, and passage through the door is not quite so convenient with only a few strips. Thus, in FIG. 5, there is shown a 4 inch strip 34, and in FIGS. 6 and 7 a series of such strips mounted in overlapping relation on a mounting bar 26.

With a strip overlap arrangement as shown in FIGS. 2–4, the right edge of the strip, where the unbonded portion 24 is located is actually elevated slightly when the strips are placed in overlapping arrangement. This tends to tilt the strip slightly so that the side edges do not hang completely vertical. However, with a relatively wide strip such as 8 inches, the pliability of the material is such that the strip simply bends or conforms slightly in the loop area so that the side edges do in fact hang substantially vertically. However, with a strip of narrower width such as that shown in FIGS. 5–7, there is less strip width to accommodate this tilting. Thus, in the narrow strip arrangement shown in FIG. 5, a portion of the loop 36 has been cut away. The upper edge is bonded to the body of the strip except for about 25 percent of the left edge which is unattached. However, the upper end of the strip 34 forming the unbonded loop portion is cut away below the upper edge of the loop, thus forming a notch 40 and a single thickness unbonded corner area 42.

Figure 5:
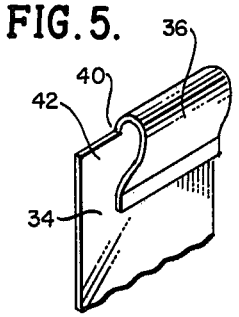
FIG. 5 is a perspective view of the upper end of a strip of narrower width showing another form of loop construction.
Figure 6:
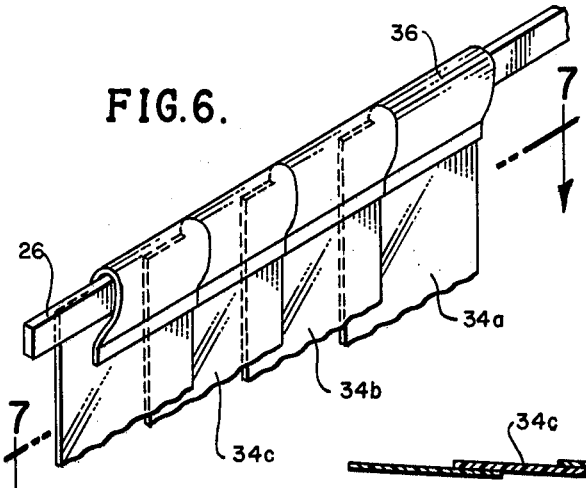
FIG. 6 is a perspective view of the upper end of a series of strips having loops of the type shown in FIG. 5 illustrating the manner in whch they are mounted.

When a series of the strips 34 are positioned on a mounting bar 26 as shown in FIG. 6, the bonded or attached right edge of a strip **34*b* is positioned over the notched left edge of the first strip 34*a*, and the right edge of a strip 34*c* is similarly positioned over the left notched edge of the middle strip 34*b*. The width of the overlap is determined by the width of the notch 40 and hence, only a single thickness of material is created on the upper edge of the bar at the top of the loops. Preferably, the single thickness corners 42 are arranged to be located between the bar 26 and the supporting wall (not shown). Thus, in the arrangement of FIGS. 5–7, the wall would be behind the bar 26**, contrary to that of FIG. 3.

Figure 7:
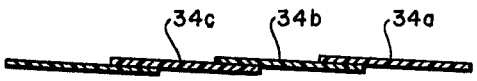
FIG. 7 is a cross-sectional view on line 7—7 of FIG. 6 illustrating the overlap of the strips.
Figure 8:
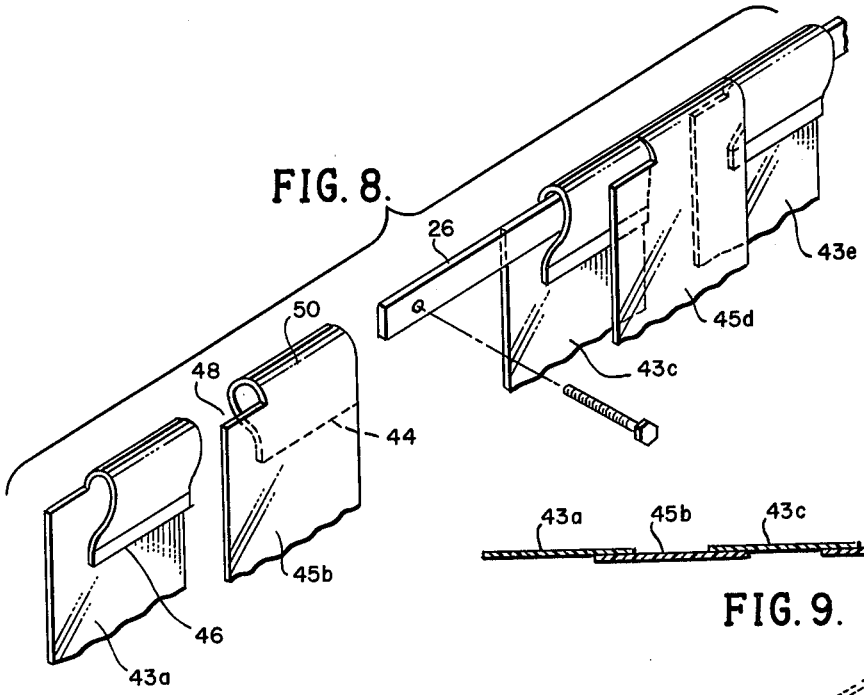
FIG. 8 is a perspective view showing the mounting of strips having the loop construction of that shown in FIG. 5 but with the loops arranged in an alternate pattern which changes the overlap arrangement.
Figure 9:
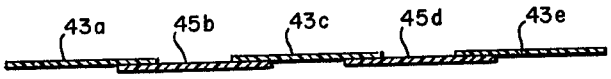
FIG. 9 is a cross-sectional view of the strips of FIG. 8 as assembled illustrating the overlap.

With the overlap arrangements shown in FIGS. 4 and 7, each strip is overlapped in the same manner. This creates what is known as a shiplap pattern. FIGS. 8 and 9 illustrate an alternate lapping pattern wherein every other strip is mounted in alternate fashion. More specifically, strips 43*a*, 43*c*, and 43*e* are identical to strip 34 shown in FIG. 5 and are mounted on a bar 26 in the same manner as in FIG. 6. However, the other two strips, 45*b* and 45*d* are formed and mounted in reverse manner from the strips 43*a*, *c* and *e*. The upper edge 44 of the strip 45*b* faces the mounting wall whereas the upper edge 46 of the strips 43*a*, *c* and *e* face away from the mounting surface. The strips 45*b* and 45*d* each have a notch 48 on the upper left-hand edge adjacent a loop 50 as do the other three strips shown in FIGS. 8 and 9. However, if the strips 45*b* and 45*d* were turned over so that their upper edges were facing away from the supporting surface as are the other three strips, the notch 48 would be located on the right edge of the strip. In otherwords, it could be said that the strips 45*b* and 45*d* are notched on the edge opposite from that of the strips 43*a*, *c* and *e*, or that the end of the strips were folded in the opposite direction in making the loop. This arrangement of strips creates an overlap pattern shown in FIG. 9, often referred to as a standard lap, wherein each strip is located completely on one side of its two adjacent strips. Such an overlap arrangement makes the strips particularly easy to walk through in that the resistance to movement is less than with the shiplap arrangement. Thus, this approach is quite useful with narrow doors in cold temperature applications wherein the material is slightly less pliable.

Figure 10:
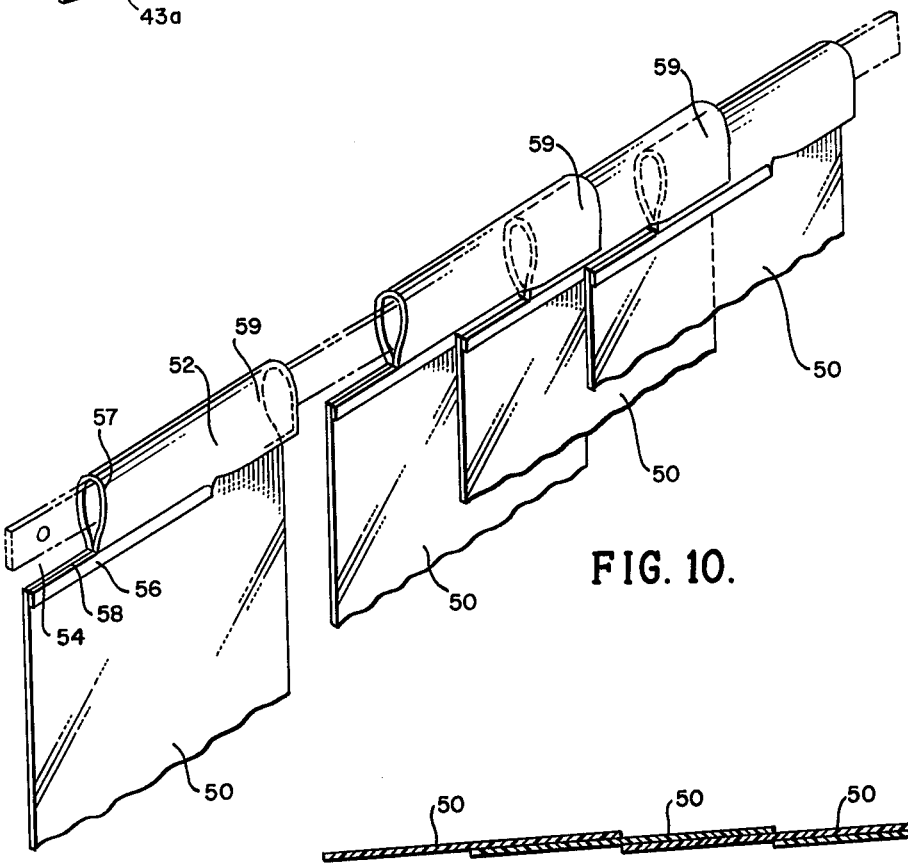
FIG. 10 is a perspective view of the mounting of a series of strips having another form of loop construction.
Figure 11:
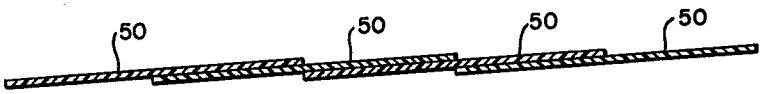
FIG. 11 is a cross-sectional view of the strips of FIG. 10 as assembled.

In some applications, it is desirable to have the entire door be of double thickness. For example, in an environment where there is considerable air movement, such as an exterior doorway in a loading dock, it may be preferable to have double door thickness, both from a standpoint of keeping the strips hanging in a vertical orientation and of having the extra insulation effect of a double door. The strips 50 in FIGS. 10 and 11 are identical to the strips 10 shown in FIGS. 2 and 3 except the left edge of the loop 52 for each strip 50 is cut away to form a notch 54. The heat bonding of forming the loop 52 was accomplished before the left edge was cut away, and the horizontal cut to remove the loop section is through the heat bonded band 56. The vertical edge 57 of the notch 54 is of course perpendicular to the horizontal cut through the heat bonded band. The advantage of this is that the upper edge 58 of the notch 54 is of double thickness. This makes the outer left corner able to support itself more easily and makes the strip stronger in the stress area at the corner of the notch where the edges 57 and 58 intersect.

With the loop arrangement of FIGS. 10 and 11, it can be seen that the right edge of one strip fits over the notched edge and adjoining loop of an adjacent strip so that the extent of the overlap is determined by the width of the unattached loop portion 59 on the right edge and the width of the notch 54 on the left edge of an adjacent strip. The width of the unbonded loop portion 59 and the notch 54 may be varied as desired, but with the arrangement shown the unbonded right portion 59 and the notch 54 of each strip are each equal to about a quarter of the width of the strip so that the overlap on each edge is about half of the strip. This results in a door of double coverage as can be seen from FIG. 11. Each strip is still adequately supported since the supporting loop 52 is in the central portion of the strip which helps the strip edges remain substantially vertical.

Double coverage but with standard overlap is obtained by forming a notch 54 of FIG. 10, or notch 40 of FIG. 5, on both edges of a loop. Also, double coverage is provided with the strips of FIGS. 6 and 8 by simply making the notches 40 and 48 half the strip width.

The mounting arrangements shown in FIGS. 2–11 are ordinarily for use against a flat wall which is the reason a bar of rectangular cross-section is employed. However, in some situations a strip door is desired in an area where there is no adjacent flat wall against which the upper ends of the strips can be pressed. In these situations, it is desiable to employ a tube or bar 60 of round cross-sections as shown in FIGS. 12 and 13. Each end of the tubular bar 60 is supported on a suitable mounting assembly 62. This includes a horizontal strip 63 to be attached to a support surface (not shown) perpendicular to the bar 60, in an upwardly opening V-shaped bracket 64 welded to the horizontal strip 63. A movable retaining element 65 extends across the upper end of the bracket 64 to lock the bar in position once it has been placed in the bracket. This arrangement is most frequently employed at the end of a truck wherein it is often not possible or practical to attach a flat bar directly to the end wall of the truck above the door opening. Instead, it is easier to attach supporting brackets to the sides of the truck. Another feature of this arrangement is that the entire door can be quickly removed and stored elsewhere if desired. For example, frequently it is desirable to move the strip door completely out from the end of the truck in situations where there is no need to have a thermal barrier.

The strips 70 shown in FIG. 12 have a loop construction similar to the strip 42 shown in FIG. 8 except that a wider strip is illustrated relative to the width of the notch. With the strips mounted on a round support bar and not pressed against a supporting wall, there is some tendencies for the strips to want to move edgewise during use, which introduces stress and wear which can in time cause tearing of a strip. To prevent this, a self-tapping screw 72 extends through the upper left corner of every other strip and is threaded into the support bar. Since this is in the overlap area, a single screw also extends through the upper right corner of the adjacent strip and thus prevents lateral movement of it as well. Also, by positioning the screws in those areas, additional support is provided to the single thickness corners of the strip, thus, adding to the strength of the support arrangement.

FIG. 13 illustrates the tubular support bar arrangement with strips 74 comparable to the strip 10 shown in FIG. 2. Again, suitable fasteners 76 are shown extending through the unbonded edge of every other strip to provide lateral stability for these strips. The arrangements of FIGS. 12 and 13 are particularly easy to assemble and mount since the entire door can be assembled on the support bar, the bar then raised into position onto its supporting brackets.

All of the arrangements illustrated have the advantage of being quick to assemble by virtue of their loop construction which enables the strips to be simply slipped down to the end of a supporting bar. This arrangement is also particularly advantageous for replacement and repair of individual strips. Since the strips can be made in the desired width and with the desired overlap, it is convenient to fit any size doorway with a strip door. Also, with the various mounting arrangements illustrated herein, the door may be tailored to fit a particular application. The heat bonding technique in forming the loops creates a particularly strong bond which is also fast and inexpensive to create.

What is claimed is:

1. A door comprising a plurality of elongated flexible strips for hanging in a wall opening, a vertical edge of each of said strips overlapping an adjacent strip, the upper end of each strip being folded on itself to form a loop sized to receive a support bar, a portion of the upper end of the strip being attached to the body of the strip at a location spaced from the end of the strip, and a portion of the upper end of said strip on one vertical edge being unattached to the body of the strip at said location to permit said unattached loop portion to overlap the edge of the adjacent strip.

2. The door of claim 1 wherein said loop on the other vertical edge of said strip is cut away forming a notch so that when the edge of said strip having said unattached loop portion overlaps a notched edge of an adjacent strip, the overlap is equal to the width of the unattached portion plus the width of the notched portion.

3. The door of claim 2 wherein said strips are made of plastic and said attached portion of the end of the strip is bonded by heat to the body of the strip, and the lower boundary of said notch is cut away along the bonded area so that said lower boundary is of double thickness.

4. The door of claim 2 wherein said unattached loop portion is about one quarter of the width of the strip and said notched portion is about one quarter of the width of the strip so that when a series of strips are placed in overlapping relation to their fullest extent, the door is of double strip thickness.

5. The door of claim 1 wherein said unattached end of the strip is cut away on a horizontal line near the top of the loop and on a line perpendicular to the top of the loop marking the boundary between said unattached portion and said attached portion so that said strip in said unattached area is no longer folded on itself but extends near the top of the loop.

6. The door of claim 5 wherein said unattached portions of the upper ends of the strips are positioned against said wall at the upper part of the wall opening and is thus clamped between the wall and bar.

7. The door of claim 5 wherein the strips are arranged so that the loops of alternate strips in a series of strips are formed with the upper edge of the strip facing opposite from the adjacent strips which creates an overlap pattern wherein each strip is located completely on one side of its adjacent strips.

8. The door of claim 1 wherein the strips are made of plastic, the portion of the upper end of each of said strips attached to the body of its strip is attached by a heat weld.

9. A door comprising a plurality of elongated flexible strips, one end of each of said strips being folded on itself and attached to the body of its strip at a location spaced from said end to form a support loop on the strip, a support bar extending through said loops, and means supporting the bar in horizontal position over a wall opening so that the strips hang in said opening in side by side relation to cover the opening, a portion of said strip end on one edge of each loop being unattached to the body of its strip at said location so that the unattached loop portion fits over the loop of the adjacent strip and a vertical edge of each strip overlaps a vertical edge of an adjacent strip.

10. The door of claim 9 including fastener means extending through alternate ones of said strips in said overlapping loop portions and into said bar to prevent lateral movement of said loops on said bar.

11. A door comprising a support bar for extending across a doorway above the doorway, a plurality of elongated flexible, heavy, plastic strips for hanging fron said bar across said doorway with a vertical edge of each strip overlapping the vertical edge of an adjacent strip, and means mounting said bar against the wall above said doorway, each of said strips having a notch cut-out of an upper corner of its strip, each of said loops being formed by folding the upper end of its strip on itself and attaching the end of the strip to the body of the strip, the upper horizontal edge of the strip forming said notch being located slightly below the upper end of the loop so that only a single thickness of plastic extends over the bar in the over lap areas and the notched corner of each strip is clamped between said wall and said bar.

12. A door comprising a plurality of elongated flexible strips, one end of each of said strips being folded on itself and attached to the body of its strip at a location spaced from said end to form a support loop on the strip, a support bar extending through said loops, and means supporting the bar in horizontal position over a wall opening so that the strips hang in said opening in side by side relation to cover the opening, a portion of said loop on each edge of said strip being cut away to form a notch, said notches of adjacent strips permitting the vertical edges of adjacent strips to overlap an amount equal to the width of adjacent notch widths.

13. The door of claim 12 wherein said notches are formed by cutting away the corners of the upper end of each strip on a line slightly below the upper edge of the loops, and wherein the strips are arranged so that each strip is located on one side of its adjacent strips.

14. A method of mounting a plastic strip door formed of a series of flexible strips having a loop formed on its upper end created by folding the upper end on itself and attaching the upper edge to the body of the strip, said loop having a cutaway or notched portion formed on one edge of the upper end of the strip, comprising:

positioning a first strip on a mounting bar by sliding its loop onto the bar;

positioning a second strip on the bar with the unnotched edge of the second strip overlapping the notched edge of the first strip;

positioning a third strip onto the supporting bar with the unnotched edge of its support loop overlapping the notched edge of the support loop of the second strip and with the edges of the second strip being located on the same sides of the edges of the first and third strips; and positioning a fourth strip on the bar with its unnotched loop edge overlapping the notched loop edge of the third strip and with the fourth strip being located on the same side of the third strip as is the second strip; and continuing adding strips to the door as desired in the pattern set forth wherein alternate strips have their overlap areas on each edge on the same side with respect to their adjacent strips.

* * * * *

UNITED STATES PATENT AND TRADEMARK OFFICE

CERTIFICATE OF CORRECTION

PATENT NO. : 4,095,642

DATED : June 20, 1978

INVENTOR(S) : McKinnon et al.

It is certified that error appears in the above-identified patent and that said Letters Patent are hereby corrected as shown below:

The issue date printed on the above patent is June 20, 1977 when it actually issued on June 20, 1978.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*